US007441861B2

(12) United States Patent
Fujibayashi

(10) Patent No.: US 7,441,861 B2
(45) Date of Patent: Oct. 28, 2008

(54) INK-JET RECORDING APPARATUS

(75) Inventor: Mitsuyuki Fujibayashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 374 days.

(21) Appl. No.: 11/455,485

(22) Filed: Jun. 19, 2006

(65) Prior Publication Data

US 2006/0290721 A1 Dec. 28, 2006

(30) Foreign Application Priority Data

Jun. 24, 2005 (JP) ..... 2005-184727

(51) Int. Cl.
*B41J 29/393* (2006.01)
*B41J 2/175* (2006.01)

(52) U.S. Cl. ..... 347/19; 347/85

(58) Field of Classification Search ..... 347/19
See application file for complete search history.

(56) References Cited

U.S. PATENT DOCUMENTS 6,390,601 B1 5/2002 Morita et al.

2006/0284907 A1* 12/2006 Ikeda et al. ..... 347/7

FOREIGN PATENT DOCUMENTS

JP 2001-88322 A 4/2001

* cited by examiner

*Primary Examiner*—Julian D Huffman
(74) *Attorney, Agent, or Firm*—Canon U.S.A., Inc. I.P. Division

(57) ABSTRACT

An ink-jet recording apparatus is provided which includes a movable carriage on which a recording head and an ink tank are configured to be mounted thereto, the ink tank including a light-emitting unit; a conveying roller disposed upstream of the recording head; a discharging roller disposed downstream of the recording head; a driven roller disposed to oppose a recording surface of the recording medium, the driven roller configured to be rotated by the discharging roller; and a driven roller holder configured to hold the driven roller and further configured to move the driven roller in a direction corresponding to a thickness of the recording medium such that the driven roller abuts on or parts from the discharging roller, the holder including a light-receiving unit configured to receive light from the light-emitting unit.

7 Claims, 4 Drawing Sheets

INK-JET RECORDING APPARATUS

BACKGROUND OF THE INVENTION

1. Field of the Invention

The present invention relates to a recording apparatus such as a copier, a facsimile, a printer or the like, and in particular, relates to an ink-jet recording apparatus that performs recording on a recording medium by discharging ink from a recording head.

2. Description of the Related Art

A recording apparatus functioning as a printer, a copier, a facsimile, etc.; or a recording apparatus used as combination electric equipment including a computer, a word processor, etc.; or a recording apparatus used as output equipment for a workstation etc., generally records an image or the like on various recording media like a sheet of paper, a fabric, a plastic sheet, a transparent sheet used for an overhead projector, etc. in accordance with recording information.

The recording apparatus typically utilizes one of an ink-jet method, a wire dot method, a thermal method, a laser beam method, or the like to accomplish the recording.

Incidentally, with a serial type recording apparatus which performs recording with main scanning on the recording medium in a direction intersecting with a conveying direction, the recording medium is recorded by repetitive operations of recording an image with use of a recording unit mounted on a carriage which moves along the recording medium; feeding a predetermined amount of the recording medium after the recording for a line is completed; and then recording the image for the next line.

On the other hand, with a line type recording apparatus which performs the recording merely with sub scanning on the recording medium in the conveying direction of the recording medium, the recording medium is entirely recorded by repetitive operations of setting the recording medium at a predetermined recording position; recording an image for a line at once; feeding a predetermined amount of the recording medium; and then recording the image for the next line at once.

In the above-described recording apparatuses, the ink-jet recording apparatus performs the recording by discharging ink by the recording unit to the recording medium, allowing the recording unit to be downsized, and enabling high-speed recording of high-definition images without a special treatment on a sheet of plain paper. In addition, such a recording apparatus has advantages of low-operation cost, low-noise since the recording apparatus employs a non-impact recording method, and easy-recording of color images with use of multicolor inks.

Further, since the ink-jet recording apparatus employs a non-contact recording method, the ink-jet recording apparatus may record an image on various types of recording media. The types of recording media used for the recording may be classified by physical characteristics of the recording media, such as a sheet of plain paper, a sheet of special purpose paper with the optimum ink-absorbing ability for ink-jet recording, and the like, or may be classified by forms of the recording media, such as an envelope or a card of a typical size, a compact disc, and the like.

The recording head used by the foregoing ink-jet recording apparatus includes a plurality of discharging nozzles for discharging ink drops, so that the ink drops are discharged from the discharging nozzles in accordance with a discharge signal on the basis of recording data to perform the recording on the recording medium.

Incidentally, as for the serial type recording apparatus, there is a configuration in which the recording head is detachably attached to the carriage which may move in a reciprocating manner.

In addition, U.S. Pat. No. 6,390,601 discloses a configuration in which a plurality of ink tanks are detachably attached to a carriage. There is also disclosed a configuration to mount the plurality of ink tanks at regular positions in the carriage, namely a configuration to prevent the ink tanks from being mounted incorrectly.

A related art for preventing the ink tank from being mounted incorrectly may be a configuration in which the profile of the ink tank differs based on color, or may be a configuration in which each ink tank has a memory chip to form an independent electric communication circuit for each ink tank.

However, according to the configuration in which the profile of the ink tank differs based on color, the number of dies for manufacturing the ink tanks may increase, thereby increasing the cost, and management or the like of the quantity for manufacturing may be cumbersome. On the other hand, according to the configuration in which the ink tank is formed with the independent electric communication circuit, connecting features may need complicated paths, and a space for accommodating the electric communication circuit for each tank may be required, causing the apparatus to be increased in size.

SUMMARY OF THE INVENTION

The present invention is made in the light of the above-described technical problems, and provides a recording apparatus which can detect a state of an ink tank mounted on a carriage with a simple configuration.

According to an exemplary embodiment of the present invention, an ink-jet recording apparatus is provided which includes a movable carriage on which a recording head and an ink tank for supplying ink to the recording head are configured to be mounted thereto, the ink tank including a light-emitting unit; a conveying roller for conveying a recording medium, the conveying roller disposed upstream of the recording head; a discharging roller for discharging the recording medium, the discharging roller disposed downstream of the recording head; a driven roller disposed to oppose a recording surface of the recording medium, the driven roller configured to be rotated by the discharging roller; and a driven roller holder configured to hold the driven roller and further configured to move the driven roller in a direction corresponding to a thickness of the recording medium such that the driven roller abuts on or parts from the discharging roller, the holder including a light-receiving unit configured to receive light from the light-emitting unit.

According to an aspect of the present invention, the ink-jet recording apparatus is configured to record at least on a sheet of plain paper or on an optical disc, and wherein the driven roller holder is configured to be moved such that the driven roller parts from the discharging roller when recording on the optical disc.

According to another aspect of the present invention, the carriage is movable in the direction corresponding to the thickness the recording medium. According to another aspect of the present invention, a movement distance of the driven roller holder in a direction corresponding to the thickness of the recording medium is greater than a moving distance of the carriage in a direction corresponding to the thickness direction of the recording medium.

According to yet another aspect of the present invention, an optical axis center of the light-emitting unit is arranged at a position farther away from the recording medium than an optical axis center of the light-receiving unit when the recording is performed on the sheet of plain paper, and the optical axis center of the light-emitting unit is arranged at a position closer to the recording medium than the optical axis center of the light-receiving unit when the recording is performed on the optical disc.

Moreover, according, to yet another aspect of the present invention, the carriage is configured to accept a plurality of ink tanks to be mounted, each of the plurality of ink tanks including a light-emitting unit. Furthermore, according to yet another aspect of the present invention, the light-receiving unit includes a photoelectric element and may further include a cover for covering the photoelectric element.

Further features and aspects of the present invention will become apparent from the following description of the exemplary embodiment with reference to the attached drawings.

DESCRIPTION OF THE EMBODIMENTS

An exemplary embodiment of the present invention will be described below with reference to the accompanied drawings.

Figure 1:
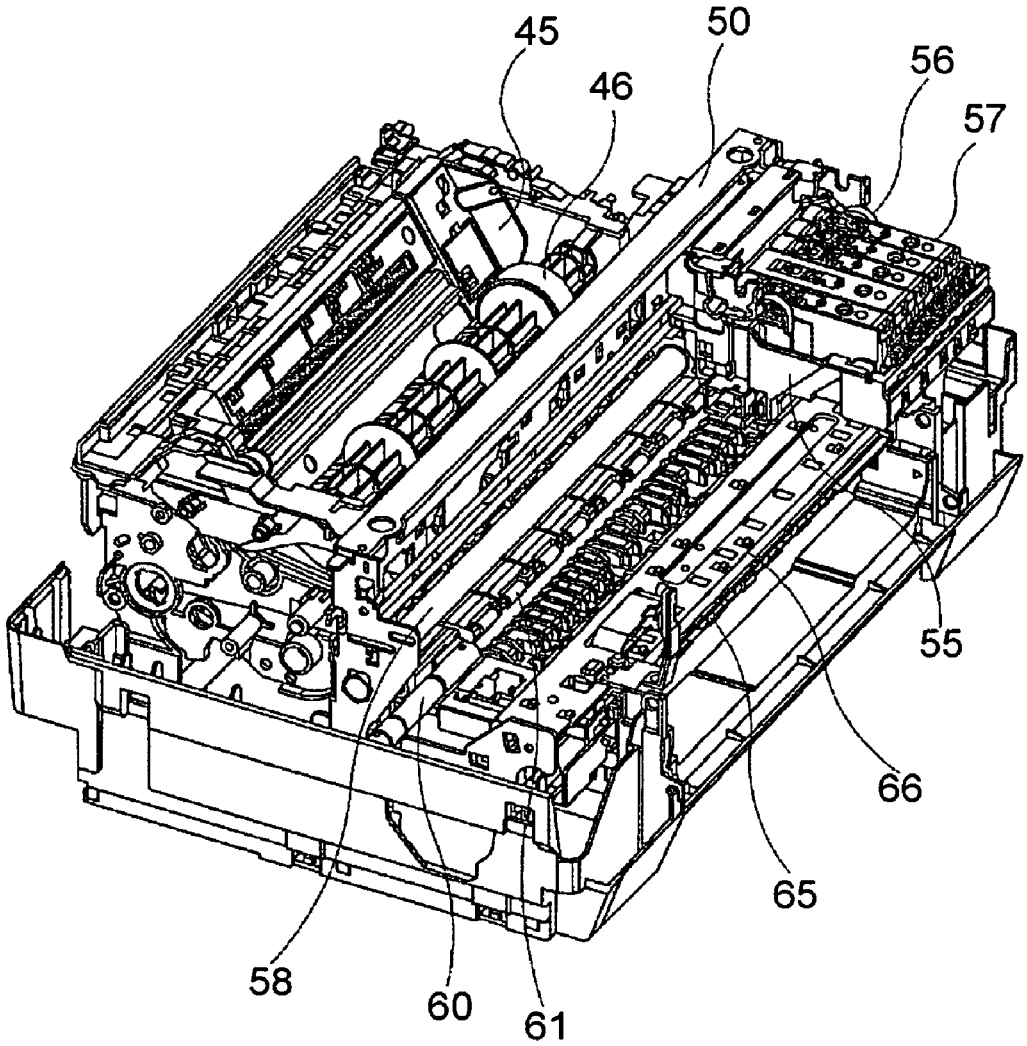
FIG. 1 is a perspective view showing an exemplary configuration of an embodiment of a recording apparatus to which the present invention is applied.

FIG. 1 is a perspective view showing an exemplary configuration of an embodiment of a recording apparatus to which the present invention is applied. The apparatus includes a feeder 45 on which a plurality of recording media are inserted to be fed individually to a recording portion, a feeding roller 46 arranged in the feeder 45 to feed the recording media, and a chassis 50 defining a frame of the recording apparatus.

In addition, FIG. 1 shows a recording head 56, an ink tank 57 configured to supply ink to the recording head 56, and a carriage 55 which moves in a reciprocating manner with the recording head 56 and the mounted ink tank 57, and a guide shaft 58 guiding the movement of the carriage 55 in a reciprocating manner. Further, the recording apparatus includes a conveying roller 60 disposed upstream of the carriage 55 and configured to convey the recording medium fed from the feeder 45, a pinch roller 61 opposing the conveying roller 60 and configured to be pressed by the conveying roller 60, a discharging roller 65 disposed downstream of the carriage 55 and configured to discharge the recording medium. Also, a spur holder (driven roller holder) 66 is provided an of which a spur (or driven roller) 67 (not shown in FIG. 1; see FIGS. 3 and 4) is disposed therein opposing the discharging roller 65 and being pressed by the discharging roller 65.

The present exemplary embodiment shows a case in which the recording apparatus employs the ink-jet method, and the recording apparatus uses an ink-jet recording unit as a recording unit for recording an image on the recording medium by discharging the ink from a discharging nozzle in accordance with a recording signal. The recording unit discharges the ink by using heat energy, and includes an electrothermal transducer for generating the heat energy. In addition, the recording unit allows film boiling to be generated in the ink according to the heat energy applied to the ink by the electrothermal transducer. Accordingly, a bubble generated at this time expands and contracts, and changes the state of the ink. As a result, the ink is discharged from the discharging nozzle by this change in state.

The recording medium is installed into the feeder 45 by a user, and then image information is transmitted to the recording apparatus from a host computer or the like (not shown) connected with the recording apparatus in a manner enabling communication. When receiving the image information from the host computer, the recording apparatus instructs the feeder 45 to start operation. The recording medium is fed to the recording portion from the feeder 45, so that the image is recorded on the recording medium by the recording portion in accordance with the image information.

Figure 2:
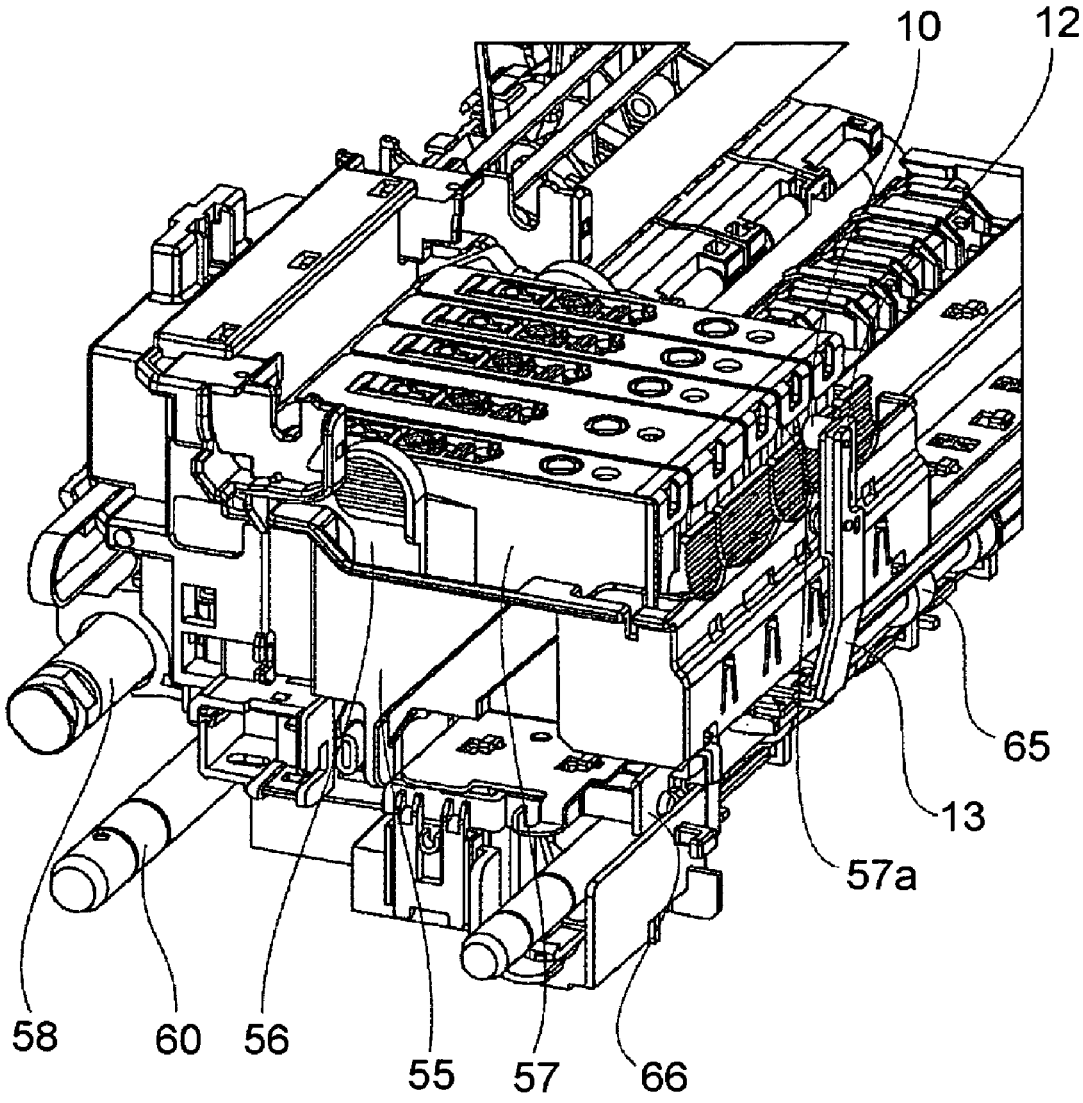
FIG. 2 is a perspective view showing a carriage with a mounted ink tank as seen from a front left side of the recording apparatus according to an aspect of the present invention.
Figure 3:
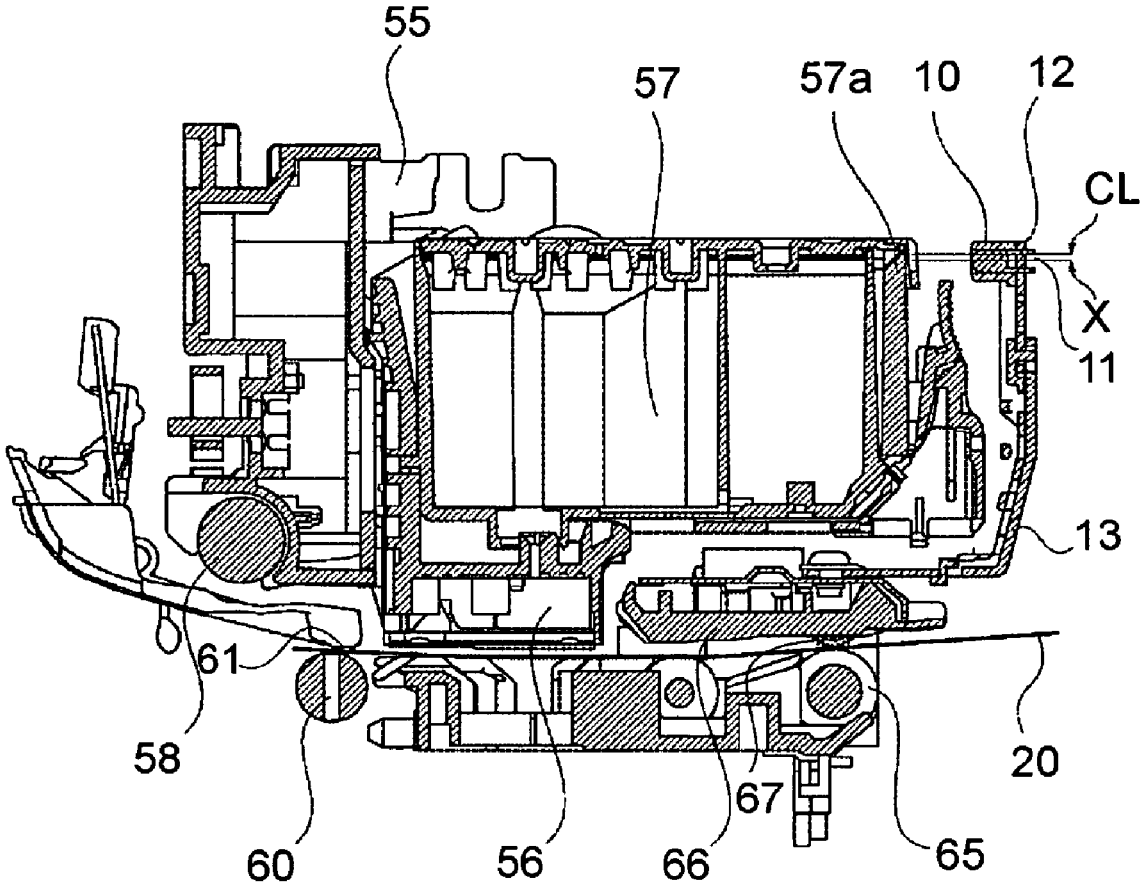
FIG. 3 is a cross section showing the carriage and a spur holder as seen from a left side when recording is performed on a sheet of plain paper according to an aspect of the present invention.
Figure 4:
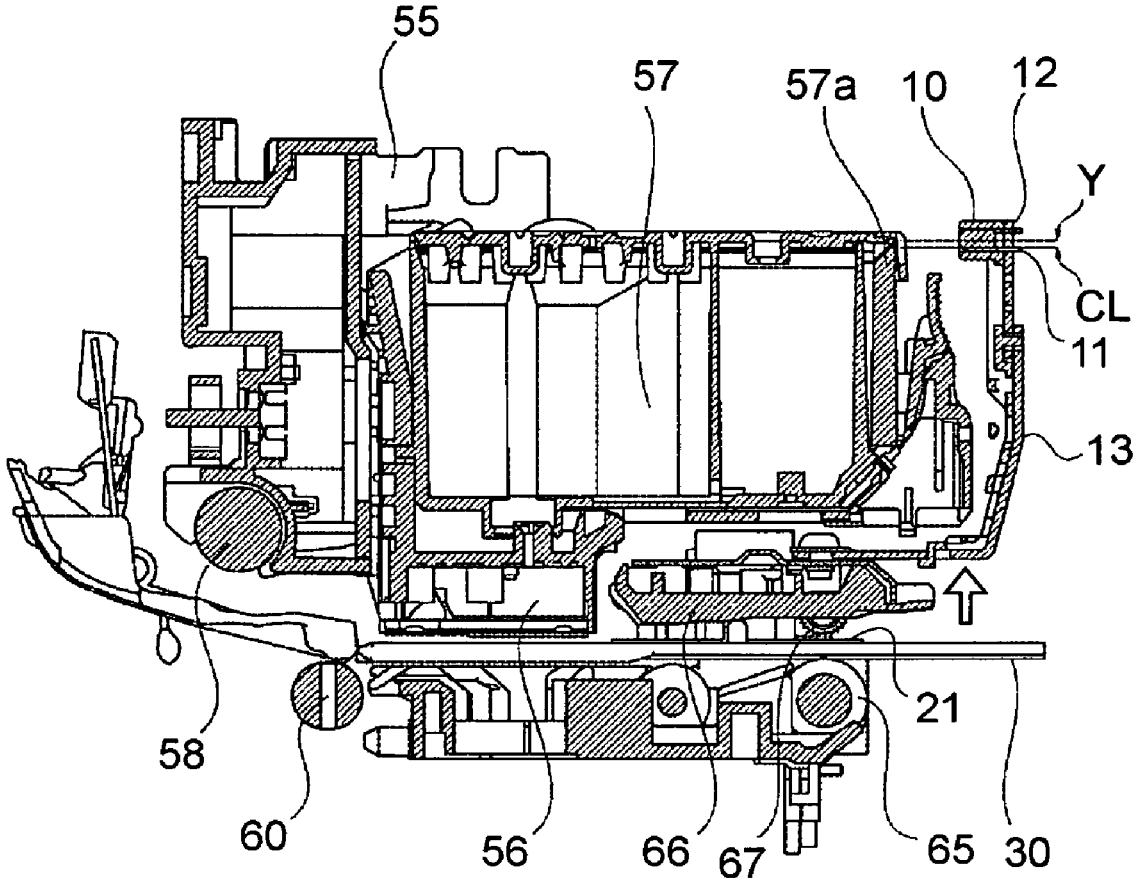
FIG. 4 is a cross section showing the carriage and the spur holder as seen from the left side when the recording is performed on an optical disc mounted on a tray according to an aspect of the present invention.

FIG. 2 is a perspective view showing the carriage 55 with the mounted ink tank 57 as seen from a front left side of the recording apparatus. FIGS. 3 and 4 are cross sections each showing the carriage 55 and the spur holder 66 as seen from a left side. As shown in FIGS. 2 through 4, the ink tank 57 is provided with a light-emitting unit 57*a* which, for example, may be constituted by a light guide that guides light from an LED (not shown). Each ink tank preferably has the LED and a memory chip, which are connected in parallel to a control board of the recording apparatus. With such a configuration, the LED can be turned ON/OFF in a desired manner even if the number of communication circuits is small. A light-receiving unit 11 (see FIG. 3) receives the light emitted from the light-emitting unit 57*a* and has an attached shield cover 10 for reducing noise factor such as outside light. The light-receiving unit 11 is connected to a control board of the recording apparatus via the electric board 12. The light-receiving unit 11, the shield cover 10 and the electric board 12 are fixed to the spur holder 66 by a stay 13.

Next, exemplary operations of the light-emitting unit 57*a* arranged in the ink tank 57 and the light-receiving unit 11 arranged on the spur holder 66 will be described. The carriage 55 moves in a reciprocating manner as guided by the guide shaft 58, and in this time, the control board controls the desired light-emitting unit 57*a* of the ink tank 57 to emit light. Simultaneously, the light-receiving unit 11 is activated to obtain information on the ink tank 57. The information may be positional information or the like of each ink tank 57 linked with a position of the carriage 55.

FIG. 3 is a cross section showing the carriage 55 and the spur holder 66 as seen from the left side when the recording is performed on a recording medium 20, such as sheet of plain paper. The conveying roller 60 and the pinch roller 61 for conveying the recording medium are disposed upstream of the carriage 55, whereas the discharging roller 65 and the spur 67 for discharging the recording medium are provided downstream of the carriage 55. The recording medium 20 is conveyed by these rollers, and then an image is recorded on the recording medium 20 as a result of the carriage 55 moving in a reciprocating manner and the recording head 56 discharging the ink. At this time, reference character CL represents a light intensity center (peak) of the light-emitting unit 57*a* of the ink tank 57, and, reference character X represents an optical axis of the light-receiving unit 11. The optical axis X is offset to a lower side of the light intensity center CL in a direction intersecting with the recording medium 20 (thickness direction of the recording medium).

FIG. 4 is a cross section showing the carriage 55 and the spur holder 66 as seen from the left side when the recording is performed on an optical disc 21 mounted on a tray 30. When the recording is performed on the optical disc 21, movement of the guide shaft 58 upward by a cam (not shown) causes the carriage 55 to be moved upward. In addition, since the optical disc 21 may be damaged if contacting the spur 67, the spur holder 66 is moved upward when the recording is performed on the optical disc 21, so that the spur 67 is moved upward to a position where the spur 67 does not abut on the optical disc 21.

At this time, a distance by which the spur holder 66 moves upward is greater than a distance by which the carriage 55 moves upward. Therefore, in a state where the recording is performed on the optical disc 21 as shown in FIG. 4, an optical axis Y of the light-receiving unit 11 is offset to an upper side of the light intensity center CL of the light-emitting unit 57*a* of the ink tank 57 in the direction intersecting with the recording medium (thickness direction of the recording medium). In other words, the position of the light intensity center CL of the light-emitting unit 57*a* of the ink tank 57 and the position of the optical axis of the light-receiving unit 11 are vertically inversed depending on the case of recording on the sheet of plain paper 20 and the case of recording on the optical disc 21. Even though the light-emitting unit 57*a* and the light-receiving unit 11 move together and a moving amount of the light-emitting unit 11 and that of the light-receiving unit 57*a* are different as described above, information on the ink tank 57 can be stably obtained.

Note that the present invention is not limited to the configuration of the above-described embodiment, and may include various configurations modified within the scope of the prevent invention. For example, in a case where the carriage 55 moves vertically, but the spur holder 66 does not move vertically, the information on the ink tank 57 can be stably obtained by arranging the light-receiving unit 11 at a mean position corresponding to a moving distance of the light-emitting unit 57*a*.

According to the embodiment of the present invention, the recording apparatus which can detect the state of the ink tank 57 mounted on the carriage 55 may be provided with the simple configuration.

While the present invention has been described with reference to exemplary embodiments, it is to be understood that the invention is not intended to be limited to the disclosed exemplary embodiments. The scope of the following claims is to be accorded the broadest interpretation so as to encompass all modifications, equivalent structures and functions.

This application claims the benefit of Japanese Application No. 2005-184727 filed Jun. 24, 2005, which is hereby incorporated by reference herein in its entirety.

What is claimed:

1. An ink-jet recording apparatus comprising:

a movable carriage on which a recording head and an ink tank for supplying ink to the recording head are configured to be mounted thereto, the ink tank including a light-emitting unit;

a conveying roller for conveying a recording medium, the conveying roller disposed upstream of the recording head;

a discharging roller for discharging the recording medium, the discharging roller disposed downstream of the recording head;

a driven roller disposed to oppose a recording surface of the recording medium, the driven roller configured to be rotated by the discharging roller; and a driven roller holder configured to hold the driven roller and further configured to move the driven roller in a direction corresponding to a thickness of the recording medium such that the driven roller abuts on or parts from the discharging roller, the holder including a light-receiving unit configured to receive light from the light-emitting unit.

2. The ink-jet recording apparatus according to claim 1, wherein the ink-jet recording apparatus is configured to record at least on a sheet of plain paper or on an optical disc, and wherein the driven roller holder is configured to be moved such that the driven roller parts from the discharging roller when recording on the optical disc.

3. The ink-jet recording apparatus according to claim 2, wherein the carriage is movable in the direction corresponding to the thickness of the recording medium.

4. The ink-jet recording apparatus according to claim 3, wherein a movement distance of the driven roller holder in a direction corresponding to the thickness of the recording medium is greater than a moving distance of the carriage in a direction corresponding to the thickness direction of the recording medium.

5. The ink-jet recording apparatus according to claim 4, wherein an optical axis center of the light-emitting unit is arranged at a position farther away from the recording medium than an optical axis center of the light-receiving unit when the recording is performed on the sheet of plain paper, and the optical axis center of the light-emitting unit is arranged at a position closer to the recording medium than the optical axis center of the light-receiving unit when the recording is performed on the optical disc.

6. The ink-jet recording apparatus according to claim 1, the carriage is configured to accept a plurality of ink tanks to be mounted, each of the plurality of ink tanks including a light-emitting unit.

7. The ink-jet recording apparatus according to claim 1, the light-receiving unit including a photoelectric element and a cover for covering the photoelectric element.

* * * * *